US008302356B2

(12) United States Patent
Knight, III et al.

(10) Patent No.: US 8,302,356 B2
(45) Date of Patent: Nov. 6, 2012

(54) SUPPORT PEDESTAL HAVING AN ANCHORING WASHER FOR SECURING ELEVATED SURFACE TILES

(75) Inventors: Stephen J. Knight, III, Littleton, CO (US); William E. Kugler, Denver, CO (US)

(73) Assignee: United Construction Products, Inc., Denver, CO (US)

( * ) Notice: Subject to any disclaimer, the term of this patent is extended or adjusted under 35 U.S.C. 154(b) by 376 days.

(21) Appl. No.: 12/506,473

(22) Filed: Jul. 21, 2009

(65) Prior Publication Data

US 2011/0016809 A1 Jan. 27, 2011

(51) Int. Cl.
*E04B 1/00* (2006.01)
*E04B 5/00* (2006.01)
*E04B 7/00* (2006.01)

(52) U.S. Cl. ..... 52/263; 52/126.7; 52/139

(58) Field of Classification Search ..... 52/126.5–126.7, 52/263, 134, 137, 139
See application file for complete search history.

(56) References Cited

U.S. PATENT DOCUMENTS 1,436,896 A * 11/1922 Newell ..... 404/40
1,614,127 A * 1/1927 Heppes ..... 52/311.2
1,888,937 A * 11/1932 Saives ..... 404/40
2,735,523 A * 2/1956 Leyerle ..... 52/509
2,896,495 A * 7/1959 Crawford ..... 411/437
3,683,438 A * 8/1972 Tinnerman ..... 470/18
3,775,790 A * 12/1973 Tinnerman ..... 470/20
3,841,371 A * 10/1974 Thurston ..... 411/276
4,279,109 A 7/1981 Madl, Jr.
4,430,837 A * 2/1984 Kirschenbaum ..... 52/506.05
4,614,066 A * 9/1986 Koppenberg ..... 52/134
4,922,670 A * 5/1990 Naka et al. ..... 52/126.6
4,996,804 A 3/1991 Naka et al.
5,072,557 A * 12/1991 Naka et al. ..... 52/126.6
5,333,423 A * 8/1994 Propst ..... 52/126.6
5,588,264 A 12/1996 Buzon
5,624,200 A * 4/1997 Beaulieu ..... 403/217
5,953,865 A * 9/1999 Rickards ..... 52/139
6,363,685 B1 4/2002 Kugler
6,402,415 B1 6/2002 Eberle, III
6,463,704 B1 * 10/2002 Jette ..... 52/125.2
6,564,514 B1 * 5/2003 Rickards ..... 52/139
6,604,330 B2 8/2003 Repasky
6,851,884 B2 2/2005 Eberle
6,983,570 B2 1/2006 Mead (Continued)

OTHER PUBLICATIONS

Eternoivica Catalogue Price List, pp. 58-67, dated 2008.

(Continued)

*Primary Examiner* — Brian Glessner
*Assistant Examiner* — Adriana Figueroa
(74) *Attorney, Agent, or Firm* — Marsh Fischmann & Breyfogle LLP

(57) ABSTRACT

A support pedestal that is adapted to support surface tiles to form an elevated building surface. The support pedestal can include a base member that is adapted to be placed upon a fixed surface and a support plate that is disposed over the base member for supporting a surface tile. An anchoring washer is fastened to the support plate and anchors adjacent surface tiles to the support pedestal. The anchoring washers can be rotated to selectively disengage from at least one of the adjacent surface tiles. By rotating an anchoring washer in each corner of a surface tile to disengage the anchoring washers, the surface tile can be easily and rapidly removed from the building surface without necessitating the removal of adjacent surface tiles.

19 Claims, 15 Drawing Sheets

U.S. PATENT DOCUMENTS

| | | | | |
|---|---|---|---|---|
| 7,140,156 | B1 | 11/2006 | Lowe, Jr. et al. | |
| 7,168,212 | B2 * | 1/2007 | Jette | 52/220.5 |
| 7,413,371 | B2 * | 8/2008 | Arnold et al. | 403/353 |
| 7,647,732 | B2 * | 1/2010 | Rickards et al. | 52/139 |
| 7,770,345 | B2 * | 8/2010 | McConnell et al. | 52/263 |
| 7,874,113 | B2 | 1/2011 | Eberle, III | |
| 7,908,812 | B2 | 3/2011 | Eberle, III | |
| 7,918,059 | B2 * | 4/2011 | Repasky | 52/263 |
| 2002/0148173 | A1 * | 10/2002 | Kugler | 52/126.6 |
| 2004/0035064 | A1 | 2/2004 | Kugler et al. | |
| 2004/0261329 | A1 * | 12/2004 | Kugler et al. | 52/126.6 |
| 2010/0051763 | A1 | 3/2010 | Knight, III et al. | |
| 2011/0011012 | A1 | 1/2011 | Knight, III et al. | |
| 2011/0023385 | A1 | 2/2011 | Knight, III et al. | |

OTHER PUBLICATIONS

Brochure entitled Exotic Wood Tile Installation, Bison Deck Supports, a United Construction Products, Inc. Company, dated Jun. 2007.

Ironwoods Elevated Deck Tile Systems with Hanover Pedestals, Website retrieved Jun. 12, 2009.

* cited by examiner (a)

(b)

SUPPORT PEDESTAL HAVING AN ANCHORING WASHER FOR SECURING ELEVATED SURFACE TILES

BACKGROUND OF THE INVENTION

1. Field of the Invention

This invention relates to the field of support pedestals for supporting an elevated surface above a fixed surface, such as for elevated floors, decks and walkways.

2. Description of Related Art

Elevated building surfaces such as elevated floors, decks, terraces and walkways are desirable in many environments. One common system for creating such surfaces includes a plurality of surface tiles, such as concrete tiles (pavers), stone tiles or wood tiles, and a plurality of spaced-apart support pedestals upon which the tiles are placed to be supported above a fixed surface. For example, in outdoor applications, the surface tiles may be elevated above a fixed surface by the support pedestals to promote drainage, to provide a level structural surface for walking, and/or to prevent deterioration of or damage to the surface tiles forming the building surface. The support pedestals can have a fixed height, or can have an adjustable height such as to accommodate variations in the contour of the fixed surface upon which the support pedestals are placed, or to create desirable architectural features.

In many applications the surface tiles are rectangular in shape, having four corners. Each of the spaced-apart support pedestals can therefore support the corners of four adjacent surface tiles at the tile corners. Stated another way, each surface tile can be supported by four support pedestals that are disposed under each of the four corners of the tile.

One example of a support pedestal is disclosed in U.S. Pat. No. 5,588,264 by Buzon, which is incorporated herein by reference in its entirety. The support pedestal disclosed by Buzon can be used in outdoor or indoor environments and is capable of supporting heavy loads applied by many types of building surfaces. The pedestal includes a threaded base member and a threaded support member that is rotatably engaged with the base member to enable the height of the support pedestal to be adjusted by rotating the support member or the base member relative to the other. The support pedestal can also include a coupling member that can couple the base member to the support member for further increasing the height of the support pedestal, if necessary.

Support pedestals are also disclosed in U.S. Pat. No. 6,363,685 by Kugler and U.S. Patent Publication No. 2004/0261329 by Kugler et al., each of which is incorporated herein by reference in its entirety.

In some applications, the weight of the surface tiles is sufficient to keep the tiles safely supported by the pedestals. For example, concrete paver surface tiles can often be safely installed by simply placing the heavy pavers on the support pedestals. For less dense materials, such as wood or plastic, the surface tiles must typically be secured in some fashion to the support pedestals to prevent the tiles from moving in relation to adjacent tiles, or otherwise shifting on the support pedestals.

SUMMARY OF THE INVENTION

One problem associated with some methods of securing lighter weight surface tiles, such as wooden deck tiles, to underlying support pedestals is that the deck surface must maintain an aesthetically acceptable appearance. However, some methods use fasteners that are visible on the deck surface, which consumers may consider unappealing.

Another problem associated with some methods is that the surface tiles are mounted to the support pedestals in a manner that can cause damage to the surface tiles when they are removed, such as for tile replacement or for access to the surface beneath the tiles.

Another problem associated with some methods of securing the tiles is that even if the surface tiles are removable after being secured to the support pedestals, a single tile that is in the middle of the structure (e.g., not on the perimeter of the elevated building surface) can only be removed by first removing at least one adjacent surface tile. As a result, it is often necessary to remove many surface tiles to access and remove one tile that is disposed away from the surface perimeter, i.e., in a central portion of the building surface.

It is therefore one objective to provide a support pedestal that can securely support a surface tile without substantially affecting the aesthetic qualities of the building surface. It is another objective to provide a support pedestal that enables the removal of a surface tile from a building surface in a rapid and convenient manner. Any one or more of these objectives may be met in accordance with one or more of the various embodiments disclosed herein.

In one embodiment, a support pedestal is provided that includes a base member that is adapted to be placed upon a fixed surface. A support plate is disposed over the base member and includes a top surface. An anchoring washer that can be fastened to the support plate is provided, where the anchoring washer can simultaneously anchor a plurality of surface tiles to the support pedestal. The anchoring washer may be particularly adapted to release a surface tile that is anchored to the support pedestal by the anchoring washer when the anchoring washer is rotated. In one aspect, the anchoring washer has an outer perimeter and a notch formed in a portion of the outer perimeter, whereby the anchoring washer can be rotated to move the notch to a desired position, e.g., to disengage from a selected surface tile.

In one aspect, the anchoring washer can include a centrally disposed aperture for receiving a fastener to fasten the anchoring washer to the support pedestal. The aperture can also include a slot that is adapted to receive a tool for rotating the anchoring washer to a desired position. For example, the slot can be adapted to receive the end of a flat-head screwdriver or a similar tool that can be inserted into the slot to rotate the anchoring washer to a desired position.

In another aspect, the anchoring washer is substantially circular. That is, a substantial portion of the perimeter of the anchoring washer can be circular. A minimum notch angle may be desirable to ensure that the corner of a surface tile can pass through the notch, while a maximum notch angle may be desirable to ensure that the anchoring washer is capable of simultaneously anchoring a plurality of surface tiles on the support pedestal. In this regard, the notch can intersect at least about 60° of the anchoring washer perimeter and in another aspect intersects no more than about 130° of the washer perimeter, such as at least about 80° and not more than about 120° of the washer perimeter.

According to another aspect, a plurality of tile spacers extend upwardly from the top surface of the support plate, such as where the spacers are disposed on a crown member that is placed on the top surface. In another aspect, the support pedestal is a height-adjustable support pedestal. In another aspect, the support plate is disposed on a support member that is operatively attached to the base member. For example, the base member can include a cylindrical base member extension that extends upwardly when the base member is operatively placed on a fixed surface, where the base member extension includes base member threads. The support member can include a cylindrical support member extension that extends downwardly from the support plate and that is threadably attached to the base member extension, such as by being directly attached to the base member extension or by being attached to the base member extension using a coupling member disposed between the base member and the support member.

According to another embodiment, a support pedestal is provided that has an adjustable height. The support pedestal can include a base member having a base plate that is adapted to be placed upon a fixed surface, and a cylindrical base member extension having a cylindrical wall and extending upwardly from the base plate when the base member is operatively placed on the fixed surface. The cylindrical wall can include base member threads disposed on a surface of the wall. A support member is operatively attached to the base member, the support member having a cylindrical support member extension and a support plate having a top surface. The support member extension can include a cylindrical wall and support member threads disposed on a surface of the support member extension cylindrical wall, where the support member threads are adapted to threadably engage the base member threads, for example, to attach the support member to the base member and/or to adjust the height of the support pedestal. An anchoring washer is fastened to the support plate, the anchoring washer having an outer perimeter and a notch formed in a portion of the outer perimeter, the notch intersecting at least about 60° and not greater than about 130° of the washer perimeter.

In one aspect, the anchoring washer is fastened to the support plate with a threaded fastener. According to another aspect, the support pedestal also includes a coupling member that is coupled to the base member and the support member to operatively attach the support member to the base member.

According to another embodiment, an elevated building surface assembly is provided. The assembly can include a plurality of surface tiles supported and elevated by a plurality of support pedestals. The surface tiles can each include an outer edge that includes a plurality of corners with a kerf disposed in the corners. The support pedestals vertically support and elevate the surface tiles above a fixed surface, and the support pedestals include a support plate having a top surface for supporting the tiles, and an anchoring washer spaced apart from the top surface and fastened to the support plate by a fastener. The anchoring washers are disposed within the kerfs of adjacent surface tiles to anchor the surface tiles to the support pedestals. Further, the anchoring washers may be rotated to selectively disengage a surface tile from the support pedestal. For example, the anchoring washers can be substantially circular and can include a notch in an outer perimeter of the washers. When the notch is aligned with a corner of a selected surface tile, that surface tile can then be disengaged from the support pedestal.

According to one aspect, the anchoring washer includes a centrally disposed aperture for receiving a fastener, and a slot that is adapted to receive a tool for rotating the anchoring washer. According to another aspect, the surface tiles are selected from wooden surface tiles, plastic surface tiles and wood-plastic composite surface tiles. For example, the surface tiles can include at least one top board and at least two bottom rails supporting the top board, wherein the kerfs are generally disposed in an outer edge between the top board and the bottom rail. The support pedestals can have an adjustable height, and in one aspect the support pedestals include a base member that is adapted to be placed upon a fixed surface, where the base member includes a base member extension that extends upwardly when the base member is operatively placed on the fixed surface. A support member having a support member extension may be threadably attached to the base member extension.

According to another embodiment, a method for the construction of an elevated building surface assembly is provided. The method may include the step of placing a plurality of support pedestals upon a fixed surface with a predetermined spacing between the support pedestals. The elevated building surface assembly is constructed by placing surface tiles onto the support pedestals. In this regard, particularly with rectangular surface tiles, a corner of each of three surface tiles can be placed upon one of the support pedestals to partially support the three surface tiles. Other portions of the surface tiles can be supported by other support pedestals, as is desired. An anchoring washer is inserted into adjacent kerfs that are disposed in the corners of each of the three surface tiles above the support pedestals. A fourth surface tile can then be placed onto the support pedestal, such as where the fourth surface tile also includes a kerf disposed in the corner of the fourth surface tile. The anchoring washer can be rotated to a position that is adapted to anchor the four surface tiles to the support pedestal, and the anchoring washer can be secured to the support pedestal to anchor the surface tiles to the support pedestal.

To remove one of the surface tiles from the support pedestal, the anchoring washer can be loosened by rotating the anchoring washer to a position that releases one of the surface tiles from the support pedestals. The rotating steps can include inserting a tool into a slot that is disposed in the washer and rotating the anchoring washer using the tool.

These and other embodiments and aspects of support pedestals, building surface assemblies and methods for the construction of building surface assemblies will be apparent from the following description.

DESCRIPTION OF THE INVENTION

Figure 1:
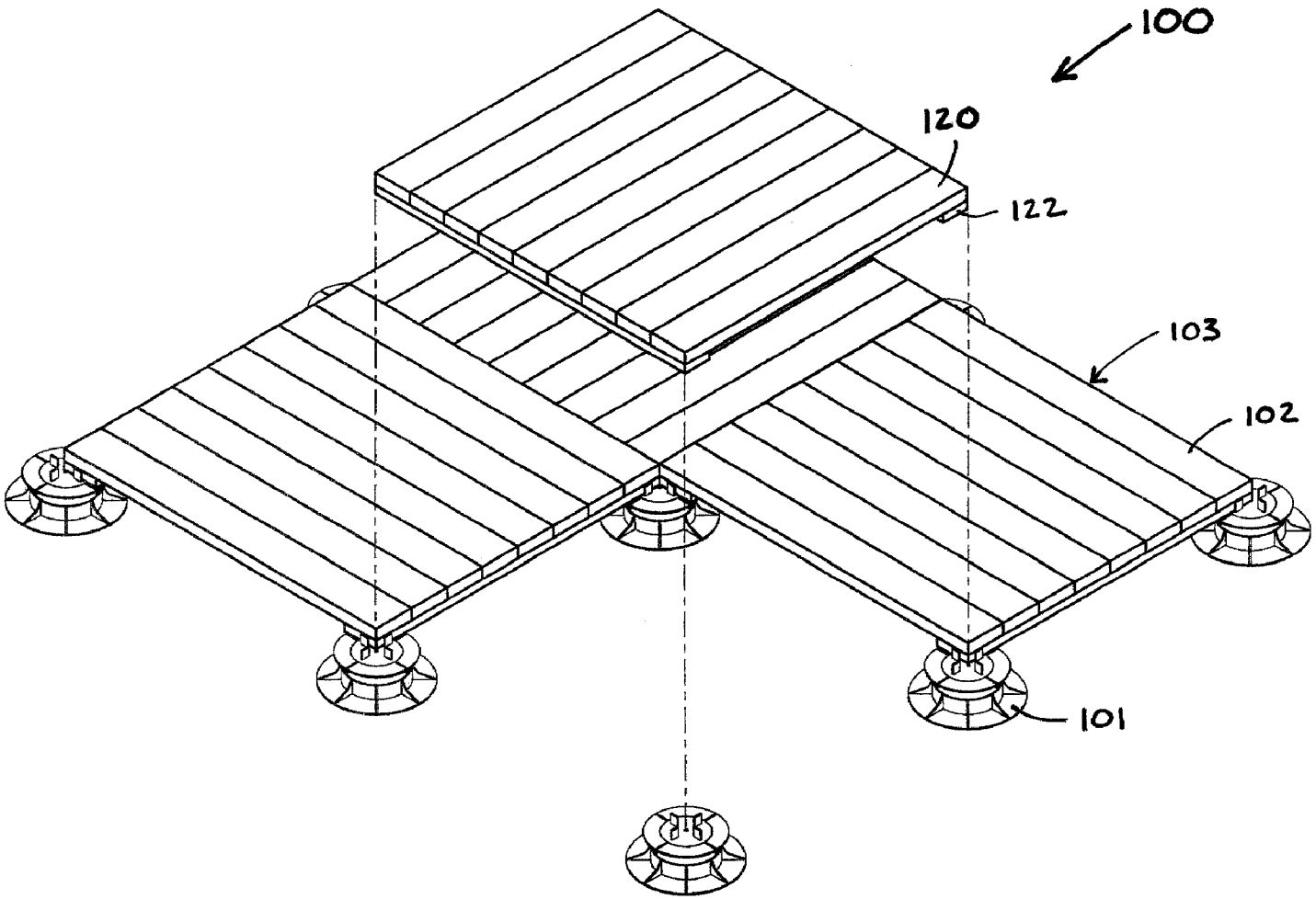
FIG. 1 illustrates a perspective view of a portion of an elevated building surface assembly.

FIG. 1 illustrates an elevated building surface assembly 100. The surface assembly 100 includes a plurality of support pedestals 101 and a building surface 103 including a plurality of surface tiles 102 disposed on and supported by the support pedestals 101. The support pedestals 101 support and elevate the surface tiles 102 above a fixed surface to form the elevated building surface 103. The tiles 102 can comprise virtually any material that is used for building surfaces, particularly relatively lightweight materials. For example, the tiles can be wooden tiles, particularly hardwood tiles that are commonly used for outdoor deck surfaces. The surface tiles 102 can also comprise a plastic material, such as plastics that are utilized for outdoor deck surfaces that are resistant to rot and corrosion. Composite materials such as wood-plastic composites can also be utilized. As illustrated in FIG. 1, the surface tiles 102 each include at least two bottom rails 122 and a plurality of top boards 120 that are attached to and supported by the bottom rails 122 to form the surface tile 102. The surface tiles 102 can have virtually any shape such as a rectangular shape, a triangular shape, octagonal shape, or others, and can be fabricated in a variety of configurations, including metal or fiberglass grating, or the like.

The support pedestals 101 can be placed in a spaced-apart relationship on fixed surfaces including, but not limited to, rooftops, on-grade (e.g., natural ground), over concrete slabs including cracked concrete slabs, and can be placed within water features, such as fountains. The elevated building surface assembly 100 can be used for both interior and exterior applications. Each of the surface tiles 102 is placed upon several support pedestals 101 to elevate the surface tiles 102 above the fixed surface. As illustrated in FIG. 1, the surface tiles 102 are square and a support pedestal 101 is disposed beneath four proximate corners of adjacent surface tiles 102 that form the elevated building surface 103. Further, although illustrated in FIG. 1 as being laid out in a symmetric square pattern, the support pedestals 101 can also be laid out in various configurations as may be dictated by the shape and size of the surface tiles.

Figure 2:
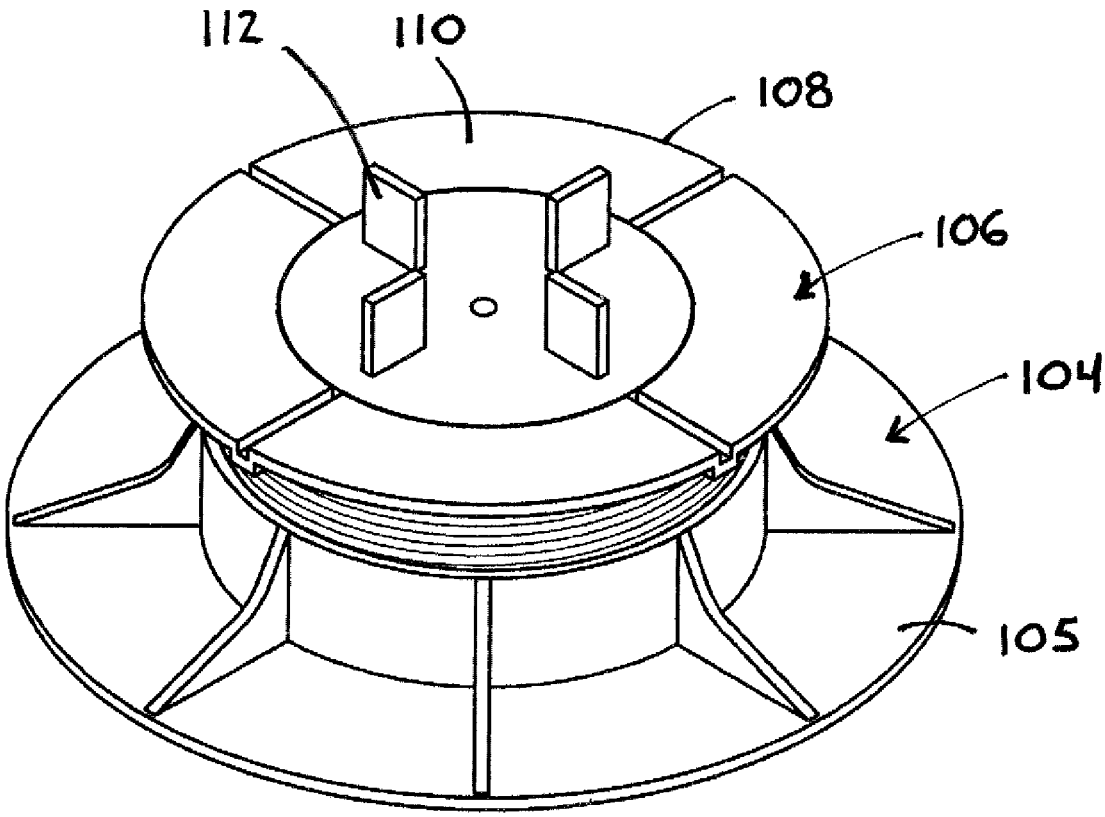
FIG. 2 illustrates a perspective view of a support pedestal.

FIG. 2 illustrates a support pedestal 101 that is useful for supporting surface tiles in an elevated building surface assembly. The support pedestal 101 includes a base member 104 having a base plate 105 that is adapted to be placed upon a fixed surface. A support member 106 is disposed over the base member 104 and is operatively attached to the base member 104. In this regard, the support member 106 is threadably attached directly to the base member 104. The support member 106 includes a support plate 108 having a top surface 110. A plurality of spacers 112 extend upwardly from the top surface 110 of the support plate 108 for providing predetermined spacing between adjacent surface tiles. Although illustrated as including a support member 106 that can be separated from the base member 104, the support pedestal can include a base member having a support plate that is integrally formed with the base member, e.g., a unitary one-piece support pedestal.

Figure 3:
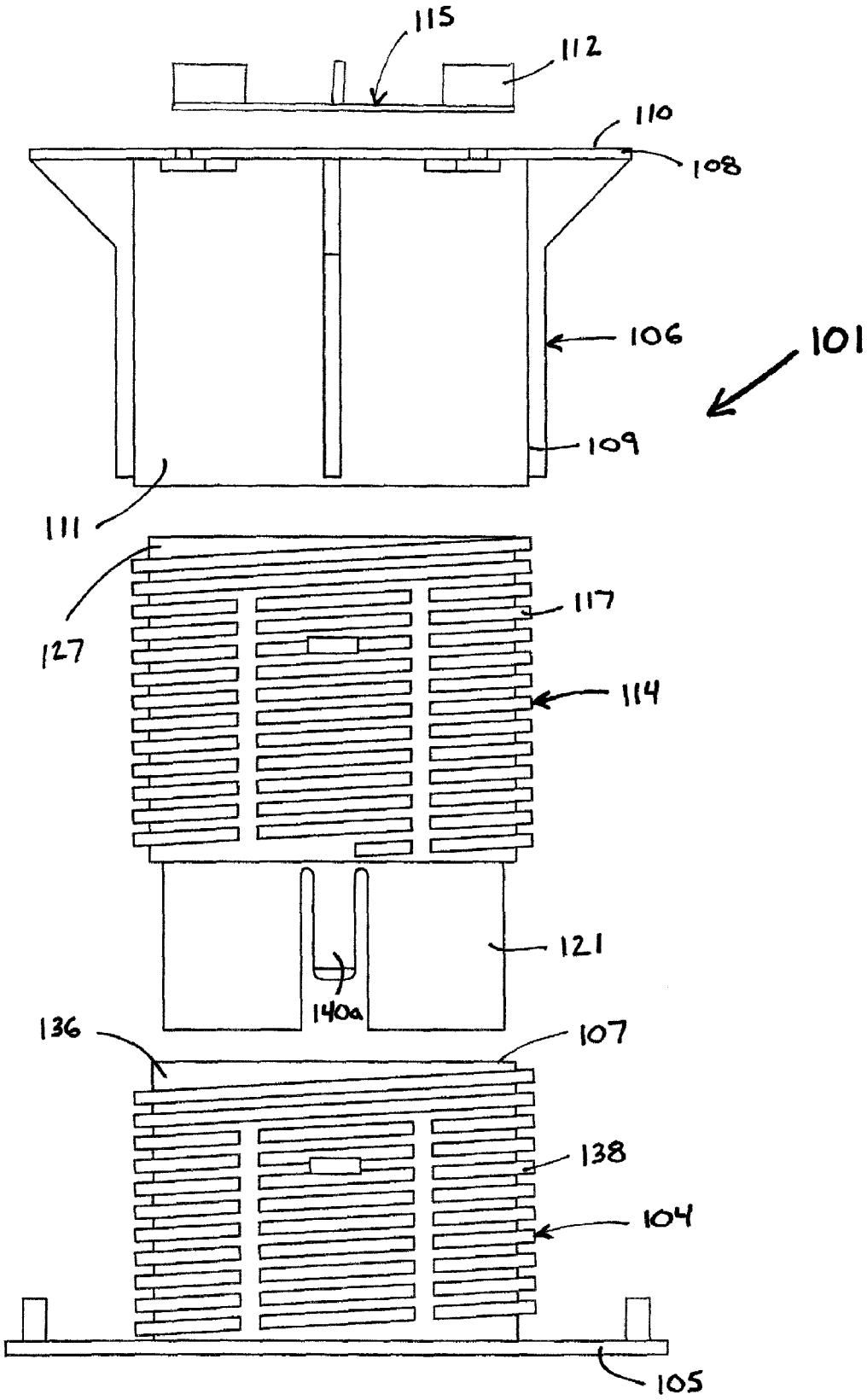
FIG. 3 illustrates an exploded side view of a support pedestal.
Figure 4:
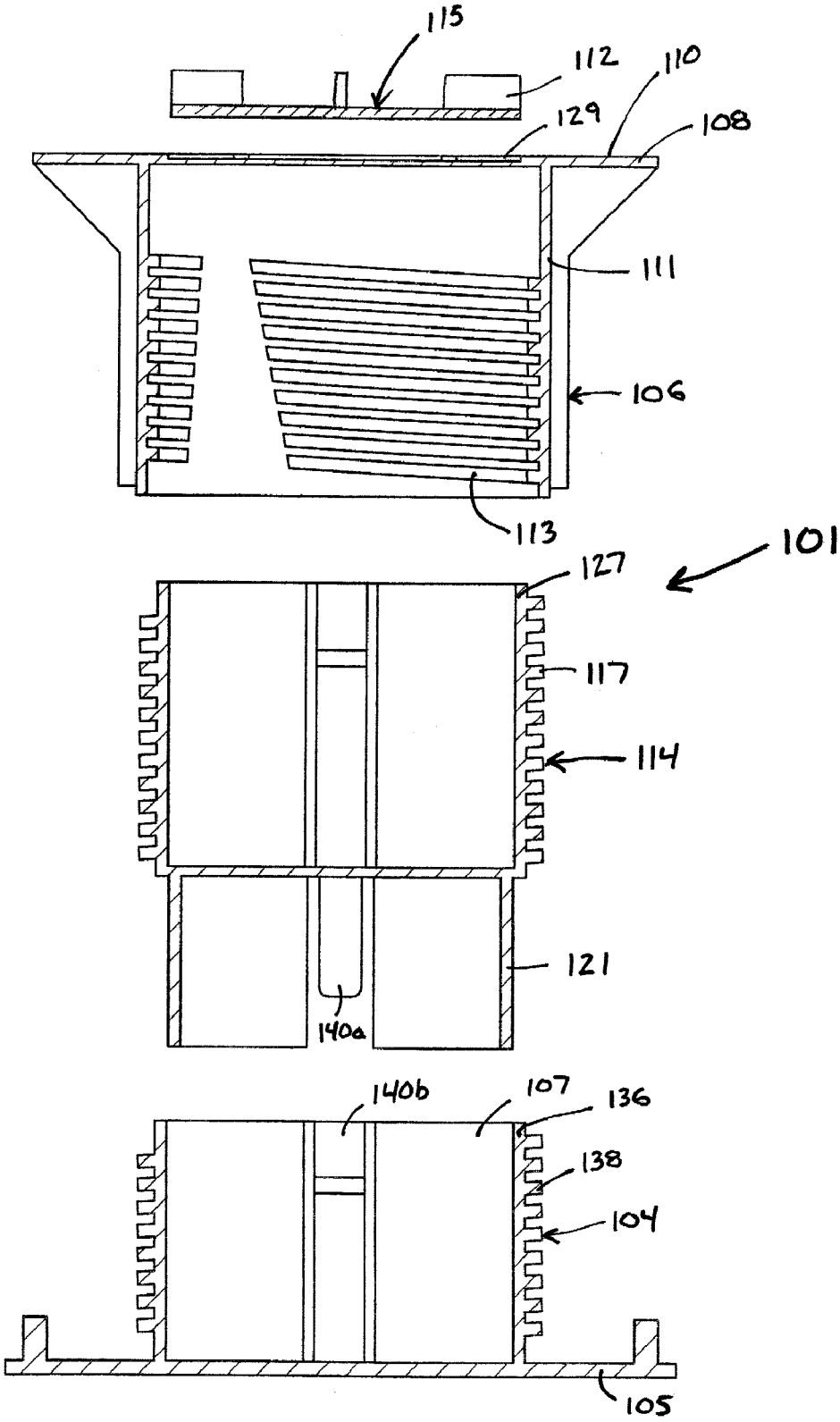
FIG. 4 illustrates an exploded cross-sectional view of a support pedestal.
Figure 5:
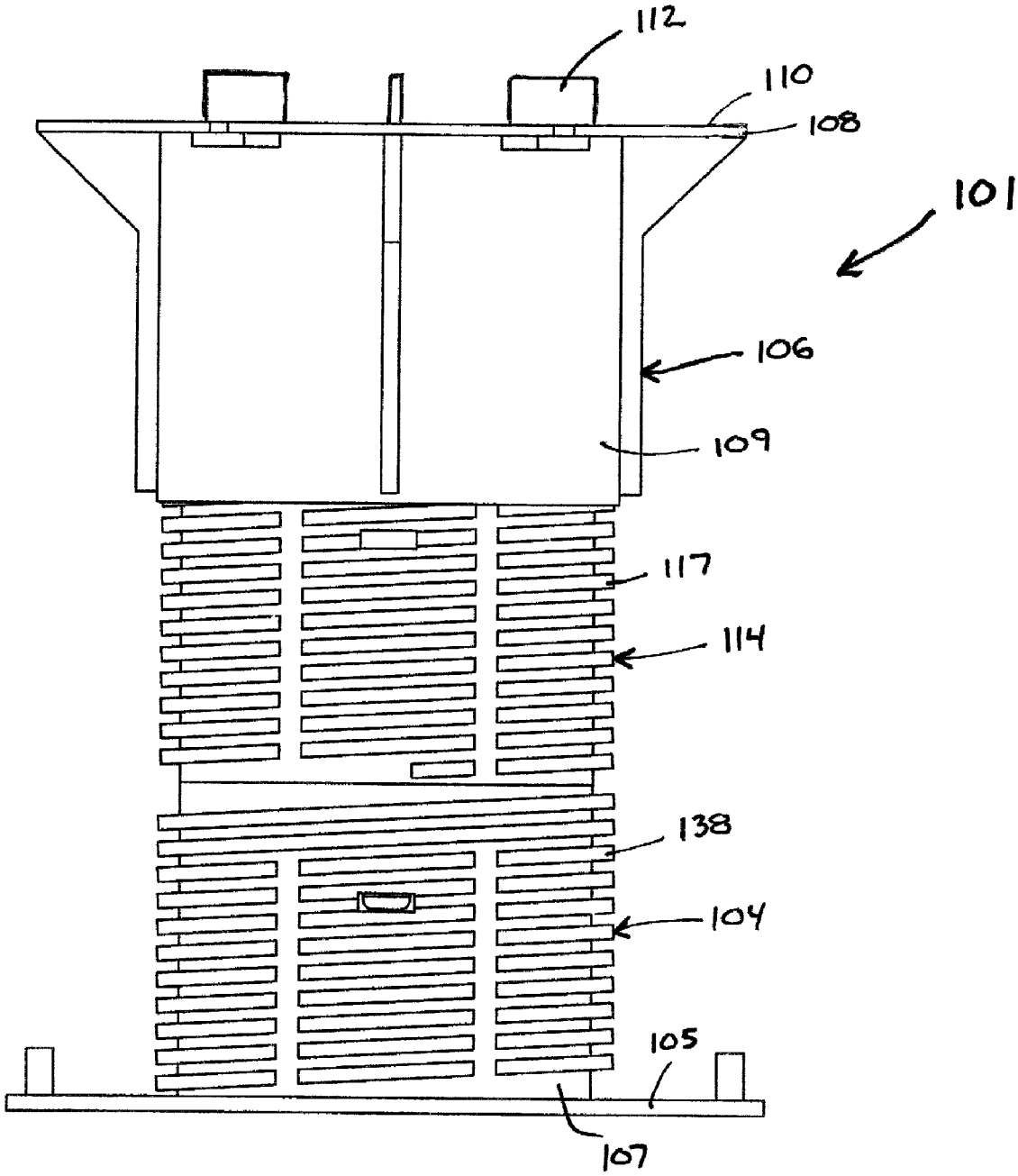
FIG. 5 illustrates a side view of an assembled support pedestal.

FIGS. 3-5 illustrate another exemplary embodiment of a support pedestal 101 including an optional coupling member. FIG. 3 illustrates an exploded side view of the support pedestal, FIG. 4 illustrates an exploded cross-sectional view of the support pedestal and FIG. 5 illustrates a side view of the assembled support pedestal. The support pedestal illustrated in FIGS. 3-5 is a height adjustable support pedestal that enables the height of the surface tiles above the fixed surface to be adjusted, for example to accommodate variations in the elevation of the fixed surface and/or to create architectural features.

The support pedestal 101 includes a base member 104 that is adapted to be placed upon a fixed surface, such as by placing the base member plate 105 on a fixed surface. The base member 104 includes a cylindrical base member extension 107 that extends upwardly from the base member plate 105 when the support pedestal 101 is operatively placed on the fixed surface. The cylindrical base member extension 107 includes a cylindrical base member extension wall 136 and base member threads 138 disposed on an outer surface of the base member extension wall 136.

A support member 106 is adapted to be operatively connected to the base member 104 and includes a top support plate 108 having a top surface 110. A cylindrical support member extension 109 extends downwardly from the support plate 108. The support member extension 109 includes a cylindrical wall 111 having support member threads 113 disposed on an interior surface of the cylindrical wall 111. The support member threads 113 can be adapted to threadably engage the base member threads 138 to connect the support member 106 to the base member 104.

As illustrated in FIGS. 3-5, the support pedestal 101 also includes a coupling member 114 that is adapted to increase the height of the support pedestal 101. The coupling member 114 includes a first cylindrical portion 121 that is adapted to slidably engage with the base member extension 107. The coupling member 114 also includes a second cylindrical portion 127 that includes coupling member threads 117 that are adapted to rotatably engage with the support member threads 113. It is important to note that the timing of the coupler member threads 117 with the base member threads 138 should be synchronized when the coupling member 114 is placed in the base member 104. As a result, the support member threads 113 can fully engage the coupling member threads 117 and continue to thread onto the base member threads 138 without binding. In this way, the support pedestal 101 can be fully adjusted through a wide range of heights without any gaps in the obtainable pedestal height. In the embodiment illustrated in FIGS. 3-5, the coupling member 114 also includes an alignment member **140*a* that is adapted to mate with an alignment member 140*b* in the base member 104 to insure the timing of the coupling member threads 117 with the base member threads 138**.

Thus, the coupling member 114 can engage both of the support member 106 and the base member 104 to couple the support member 106 to the base member 104 and provide an increased height for the support pedestal 101.

The support pedestal 101 can also include tile spacers 112 that are adapted to provide predetermined spacing for the surface tiles that are placed on the support pedestal 101. In this regard, the tile spacers 112 can project upwardly from the top support surface 110. As illustrated in FIG. 3-5, the tile spacers 112 are provided on a crown member 115 that is adapted to be placed in a recess 129 on the top support surface 110. In this manner, the crown member 115 can be freely rotated in relation to the support member 106 to accommodate the positioning of the surface tiles.

As is discussed above, an anchoring washer is utilized to anchor one or more surface tiles to a support pedestal. It is generally desirable that the anchoring washer be wholly or partially obstructed from view when observed from the top of the building surface so that the building surface maintains an aesthetically pleasing appearance. In this regard, the anchoring washer can be positioned below the top of the building surface, such as within one or more kerfs that are disposed in an outer edge of a surface tile, such as at the corner of a surface tile.

Figure 6:
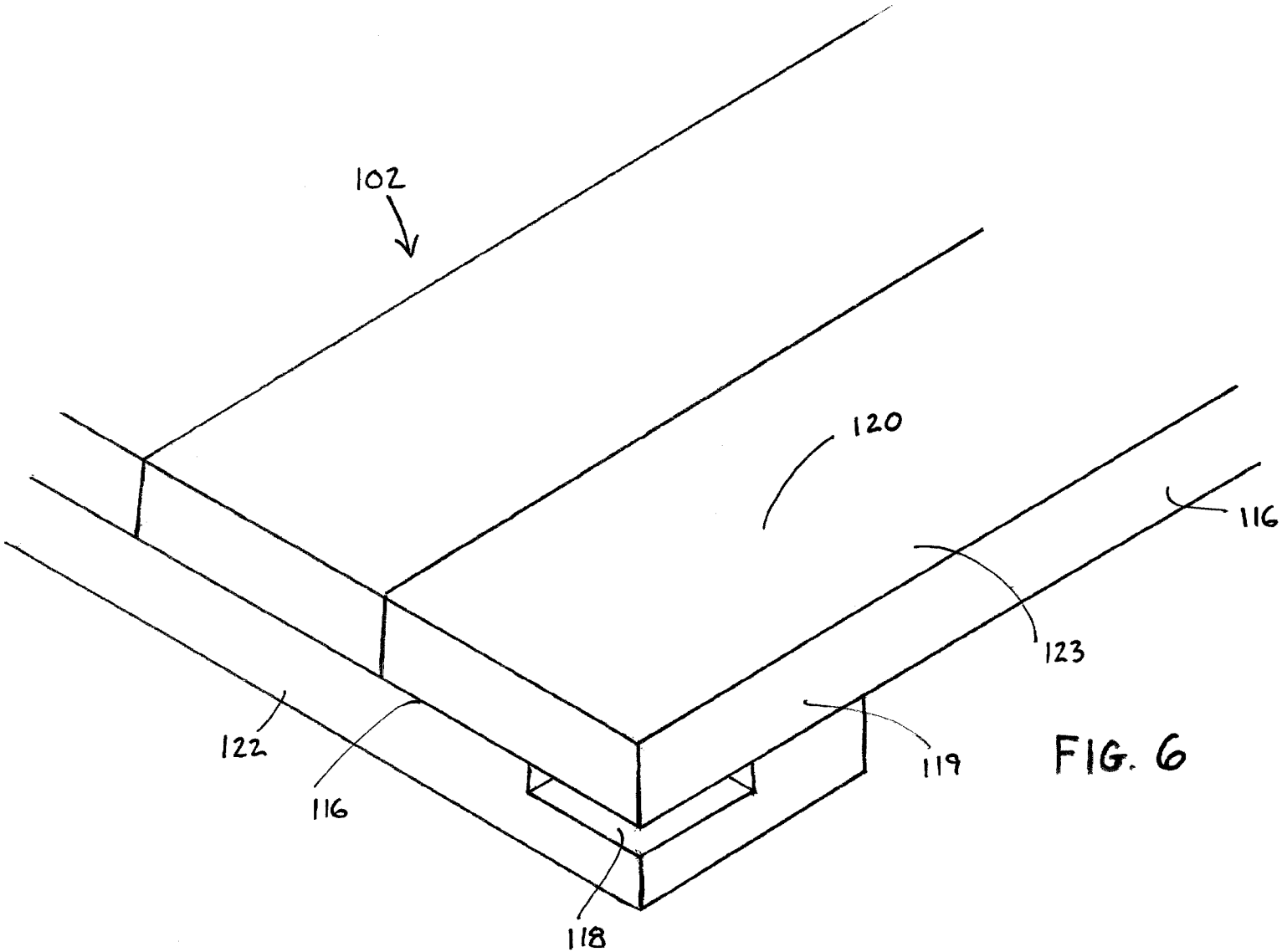
FIG. 6 illustrates a partial perspective view of a surface tile having a kerf disposed in a corner of the surface tile.

FIG. 6 illustrates a perspective view of a corner of a surface tile 102. The surface tile 102 includes a plurality of top boards 120 that are supported by and attached to a bottom rail 122. It will be appreciated that a bottom rail such as bottom rail 122 can be included along two opposite sides of the surface tile 102, or can be disposed around the entire perimeter of the surface tile 102. Further, the surface tile 102 could comprise a single unitary panel, such as one having one or more kerfs disposed in the edges of the tile.

The surface tile 102 has an outer edge 116 around the perimeter of the surface tile 102. As illustrated in FIG. 6, the outer edge 116 of the surface tile 102 is defined by outer edges of the bottom rail 122 and outer edges of the top boards 120.

A kerf 118 is disposed in the outer edge 116, particularly in a corner of the outer edge 116 of the surface tile 102. As illustrated in FIG. 6, the kerf 118 is formed by a cut in the bottom rail 122. The kerf 118 could also be formed wholly or partially in the top board 120, or at any location in the outer edge 116 between the top surface 123 of the top board 120 and the bottom surface of the bottom rail 122. It should be noted that when an anchoring washer is placed within the kerf 118, as is discussed in more detail below, the anchoring washer will be at least partially obstructed from the view of an observer by the top board 120.

Figure 7:
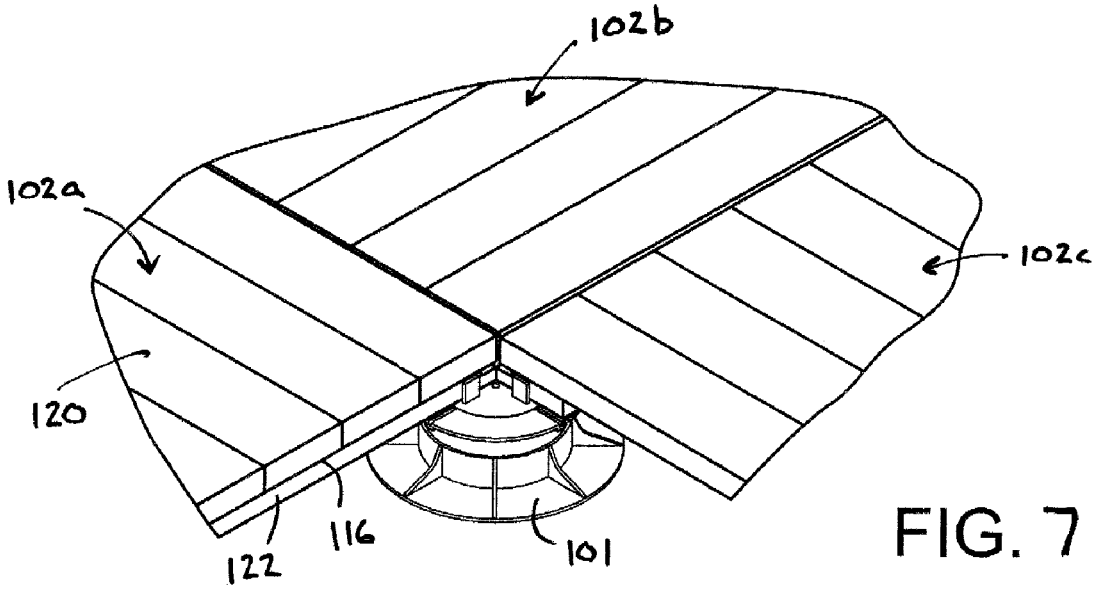
FIG. 7 illustrates a partial perspective view of a pedestal support supporting adjacent surface tiles in an elevated building surface assembly.

In constructing an elevated building surface assembly, a plurality of surface tiles, such as four surface tiles, are placed upon each support pedestal such that each of the four corners of a surface tile is supported by a support pedestal. FIG. 7 illustrates three surface tiles 102*a*-102*c* that are disposed upon a support pedestal 101, such as during construction of an elevated building surface. The support pedestal 101 supports a corner of each of the three surface tiles 102*a*-102*c*. As illustrated in FIG. 7, the bottom rails 122 of the tiles 102*a*-102*c* are placed upon the top of the support pedestal 101. Outer edges 116 of the tiles 102*a*-102*c* are disposed immediately adjacent to one another.

Figure 8:
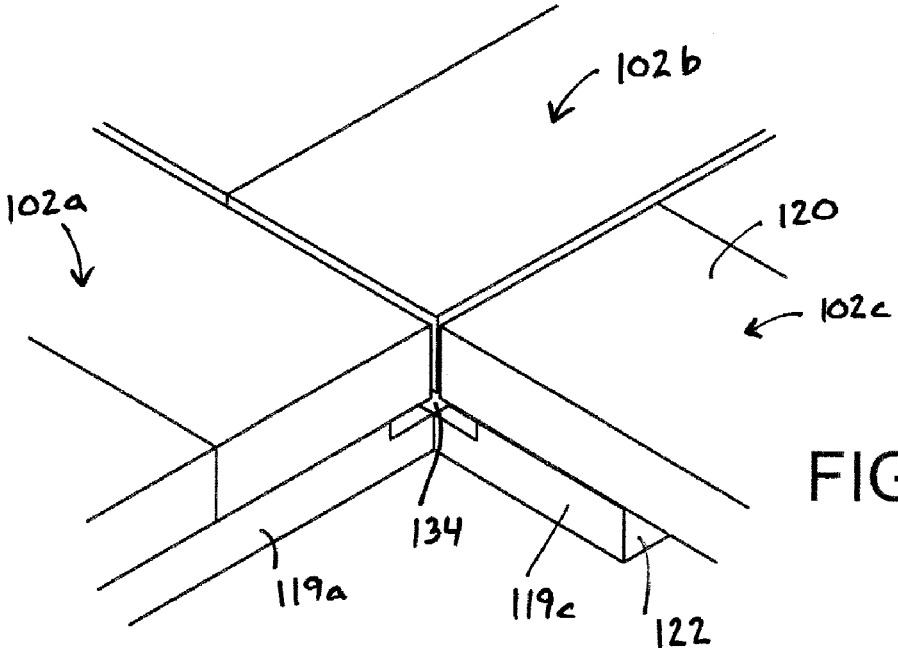
FIG. 8 illustrates a partial perspective view of adjacent surface tiles including a kerf disposed in a corner of each of the surface tiles.

In this regard, FIG. 8 illustrates a perspective view of three adjacent surface tiles 102*a*-102*c* with the support pedestal removed for purposes of illustration. A kerf is formed in an outer edge of each of the tiles 102*a*-102*c*. The tiles 102*a*-102*c* each include bottom rails 122 and a plurality of top boards 120 attached to and supported by the bottom rails 122 to form the surface tiles 102*a*-102*c*. In the embodiment illustrated in FIG. 8, the kerfs are disposed in a corner of each outer edge (e.g., outer edges 119*a* and 119*c*) between the bottom rail 122 and the top boards 120. When assembled in this manner, the kerfs are disposed in proximal relation to form a cavity 134 that is adapted to receive an anchoring washer therein to anchor the surface tiles to a support pedestal.

Figure 9:
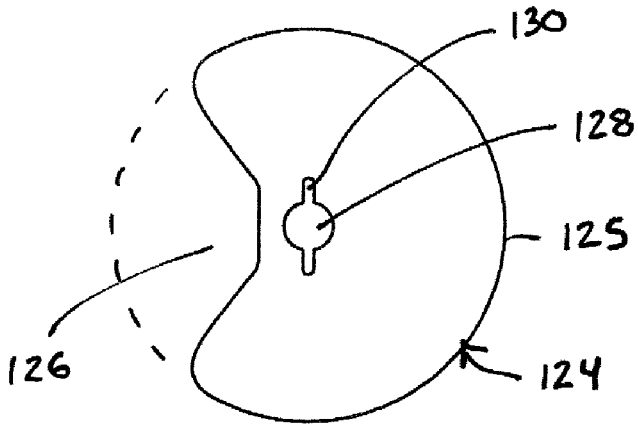
FIGS. 9*a* and 9*b* illustrate an anchoring washer having a notch in the outer perimeter of the anchoring washer.
Figure 9:
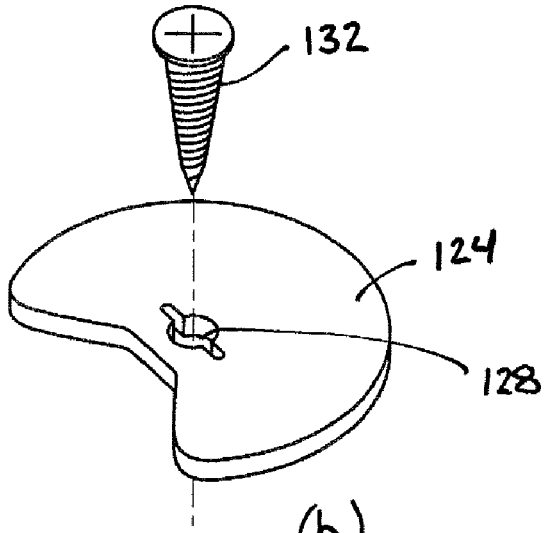

FIGS. 9*a*-9*b* illustrate an anchoring washer 124 for anchoring surface tiles to a support pedestal. The anchoring washer 124 includes an outer perimeter 125 and a notch 126 formed in a portion of the outer perimeter. As illustrated in FIG. 9*a*-9*b*, the washer 124 has a substantially circular shape, i.e., the portion of the washer not intersected by the notch 126 has a substantially constant radius. To enable the corner of a surface tile to be removed from a support pedestal by lifting the corner through the notch 126, described in more detail below, the notch 126 can intersect the perimeter of the washer by at least about 60°, at least about 80°, or at least about 90°, such as at least about 95°. To ensure that the anchoring washer is able to simultaneously anchor each tile (e.g., four tiles) to the support pedestal, the notch should intersect not more than about 130° of the washer perimeter, such as not more than about 125°, not more than about 120°, or not more than about 115° of the washer perimeter. For example, the notch 126 illustrated in FIGS. 9*a*-9*b* intersects the perimeter 125 by about 105°.

A fastener 132, such as a threaded fastener, can be inserted through the anchoring washer 124 to secure the washer 124 to the support pedestal, such as to the top support plate. The fastener 132 can be a fastener that is easily removable and replaceable. Both the fastener 132 and the washer 124 can be fabricated from a material that is resistant to corrosion, such as plastic. Other types of fasteners may be utilized to operatively fasten the anchoring washer to the support plate, including for example pop rivets or molly bolts.

The anchoring washer 124 can also include an aperture 128 having a centrally disposed slot 130. The slot 130 may be adapted to receive a tool, such as a flat head screwdriver, for rotating the washer 124. In this manner, the rotational position of the notch 126 in relation to the tiles can be changed to anchor and/or release selected tiles from a support pedestal. The slot 130 is particularly advantageous since the anchoring washer 124 is disposed within the kerfs and when the building surface is assembled, access to the washer 124 is limited to the central portion of the washer.

Figure 10:
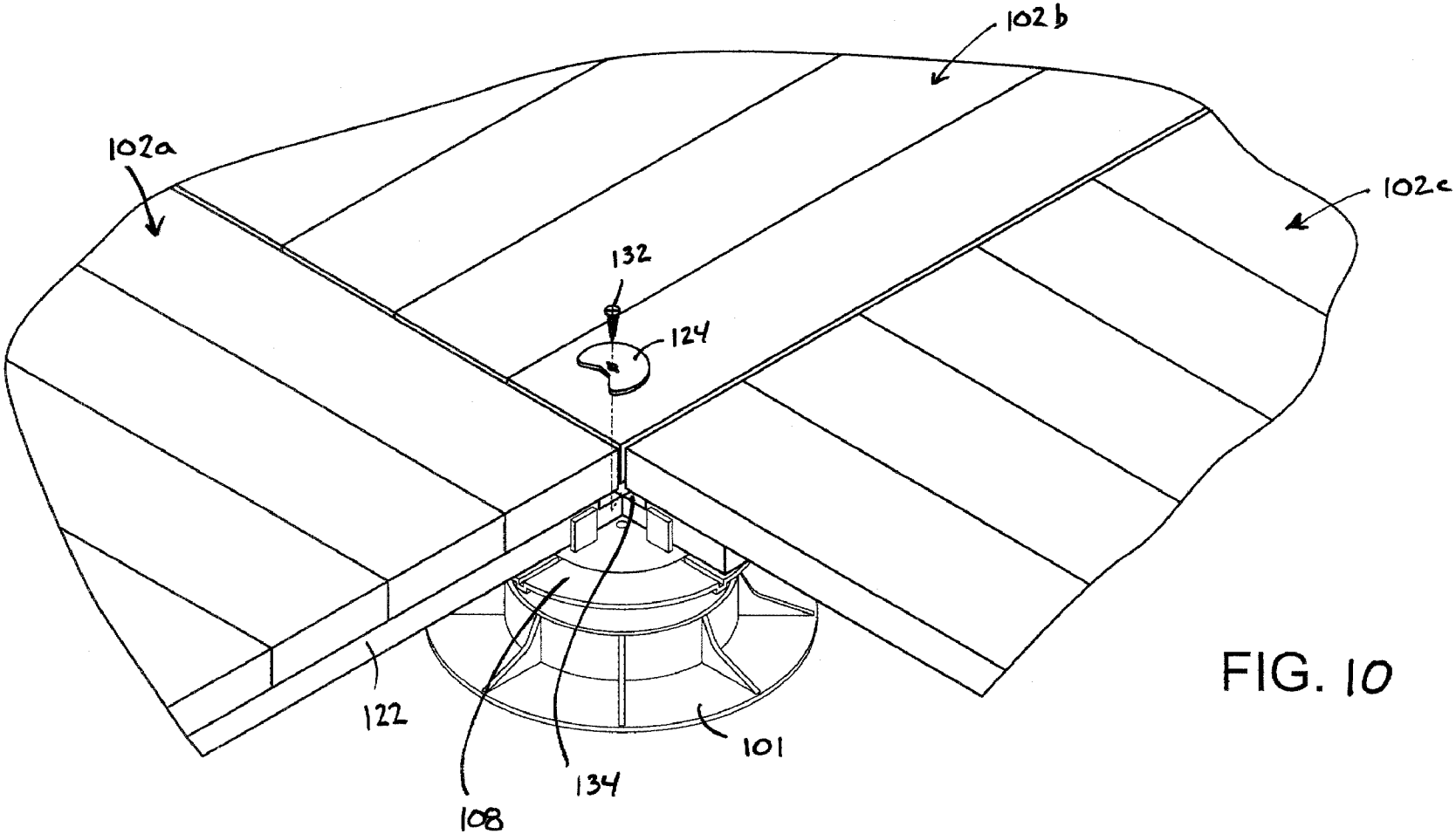
FIG. 10 illustrates a partial perspective view of an elevated building surface assembly.

FIG. 10 illustrates a perspective view of the placement of an anchoring washer 124 to anchor surface tiles 102 to a support pedestal 101. After placement of three tiles 102*a*-102*c* on the support pedestal 101, the washer 124 can be inserted into a cavity 134 formed by kerfs in the edges 122 of the surface tiles. After placement of the washer 124 within the cavity 134, the fastener 132 can be placed through the washer 124 and fastened to the support plate 108 of the support pedestal 101.

Figure 11:
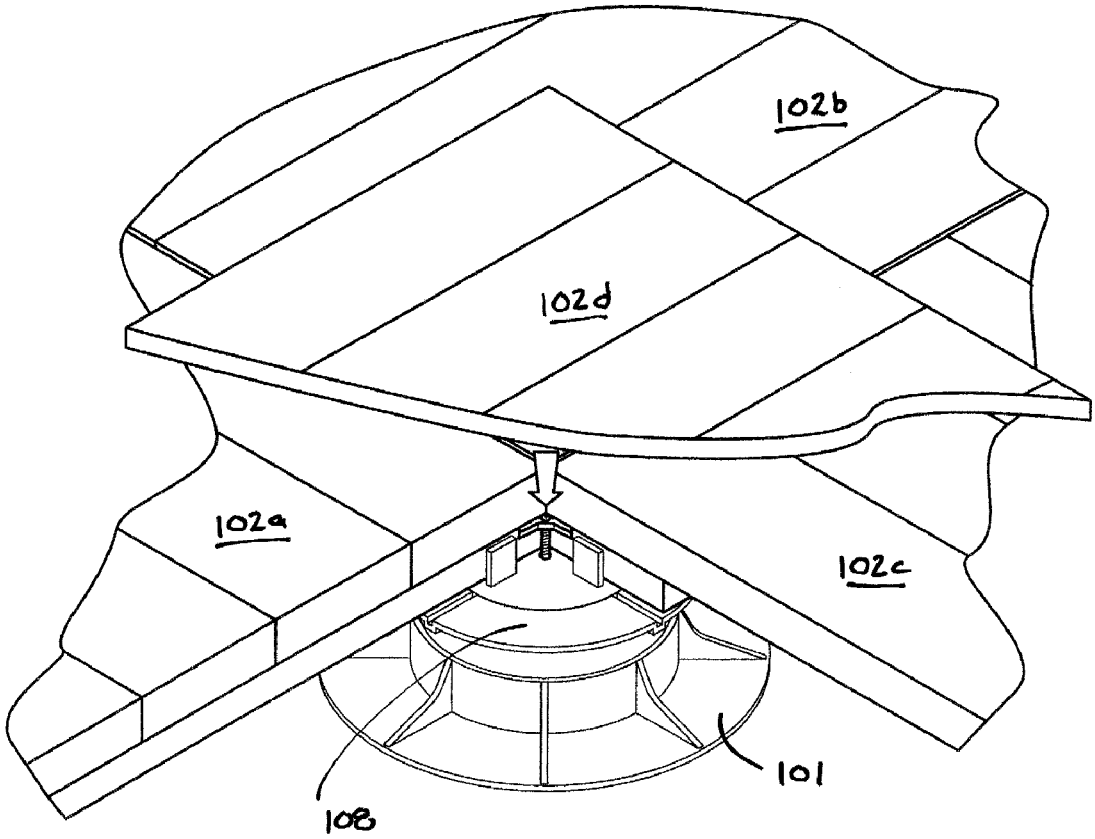
FIG. 11 illustrates a partial perspective view of an elevated building surface assembly.

Referring to FIG. 11, after placement of the anchoring washer 124 into the cavity formed by the kerfs of the three surface tiles 102*a*-102*c*, a fourth surface tile 102*d* can be placed onto the support pedestal 101. As illustrated in FIG. 11, the anchoring washer can optionally be rotated so that the notch is fully exposed in the direction of the fourth surface tile 102*d*. In this manner, the surface tile 102*d* can be placed on the support pedestal 101 by passing a corner of the surface tile 102*d* through the notch to place the surface tile 102*d* onto the support pedestal 101. After placement of the fourth surface tile 102*d*, the anchoring washer can be partially rotated, such as through an angle of about 50° to 60°, such that the anchoring washer is disposed within the kerf of each of the four surface tiles 102*a*-102*d*. Thereafter, the anchoring washer can be secured to the support pedestal 101 by tightening the fastener. As a result, all four surface tiles 102 will be securely anchored to the support pedestal 101 by the compression of the surface tile between the anchoring washer and the top surface of the support pedestal 101.

Although described as being passed through the notch of the anchoring washer during construction, it will be appreciated that the fourth surface tile 102*d* can be placed onto the support in any manner of ways. For example, the anchoring washer can be rotated to its anchoring position so that a portion of the anchoring washer is exposed, and the fourth surface tile 102*d* can be slid onto the top surface of the support pedestal 101 such that the anchoring washer is laterally inserted into the kerf of the support tile 102*d*. Thereafter, the anchoring washer can be further tightened to anchor the surface tiles to the support pedestal 101, if necessary.

Figure 12:
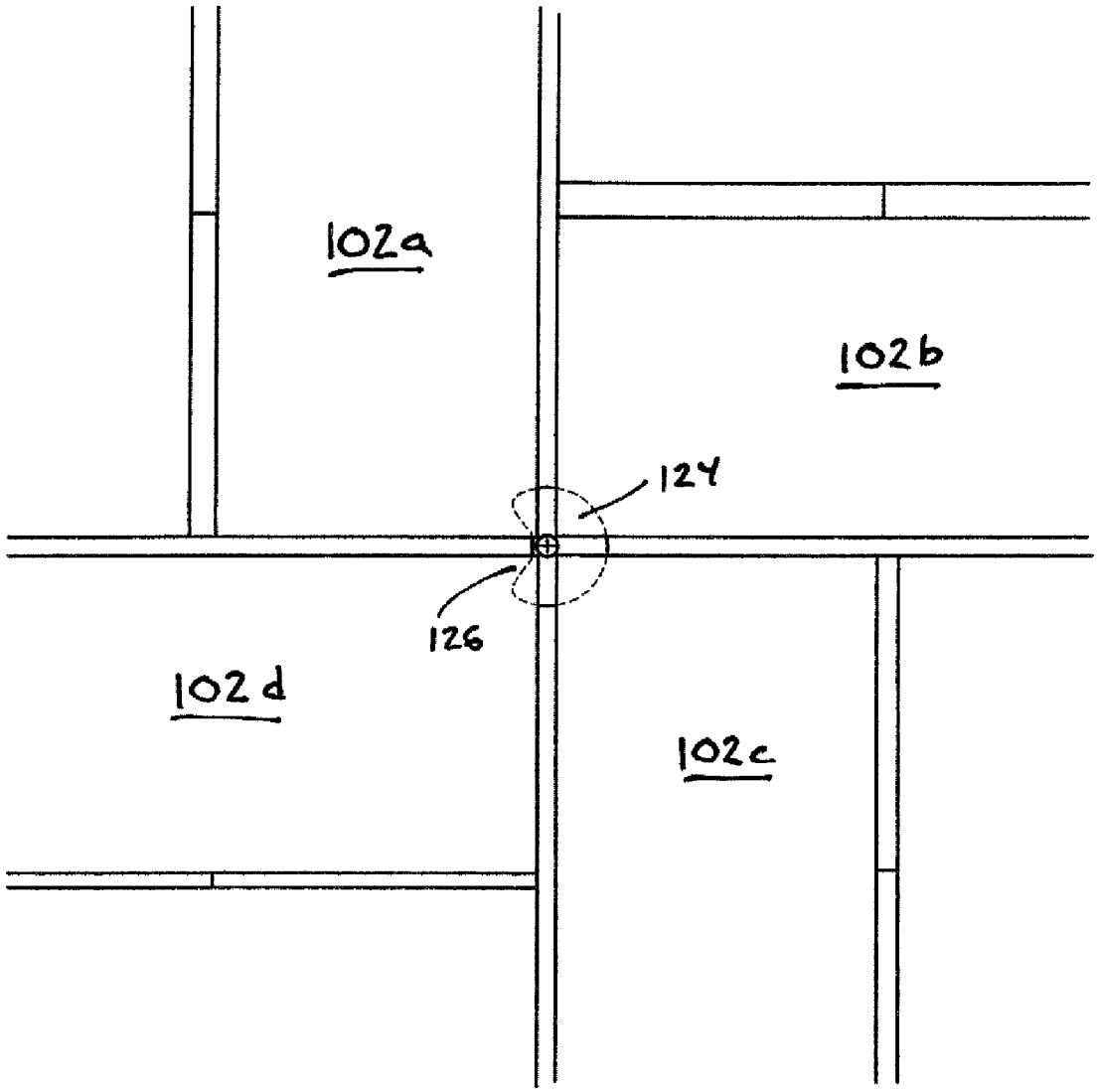
FIG. 12 illustrates a partial top view of an elevated building surface assembly.

FIG. 12 illustrates a top view of an elevated building surface assembly where an anchoring washer 124 anchors each of the four surface tiles 102*a*-102*d* to the support pedestal (not illustrated). As can be seen from FIG. 12, the anchoring washer 124 is rotated to a position such that at least a portion of the anchoring washer 124 is disposed within the kerf of each of the four surface tiles 102*a*-102*d*. The four surface tiles 102*a*-102*d* are thereby securely anchored to the support pedestal. A gap between adjacent surface tiles provides access to the fastener and the anchoring washer, while substantially obscuring the fastener and anchoring washer from view.

Figure 13:
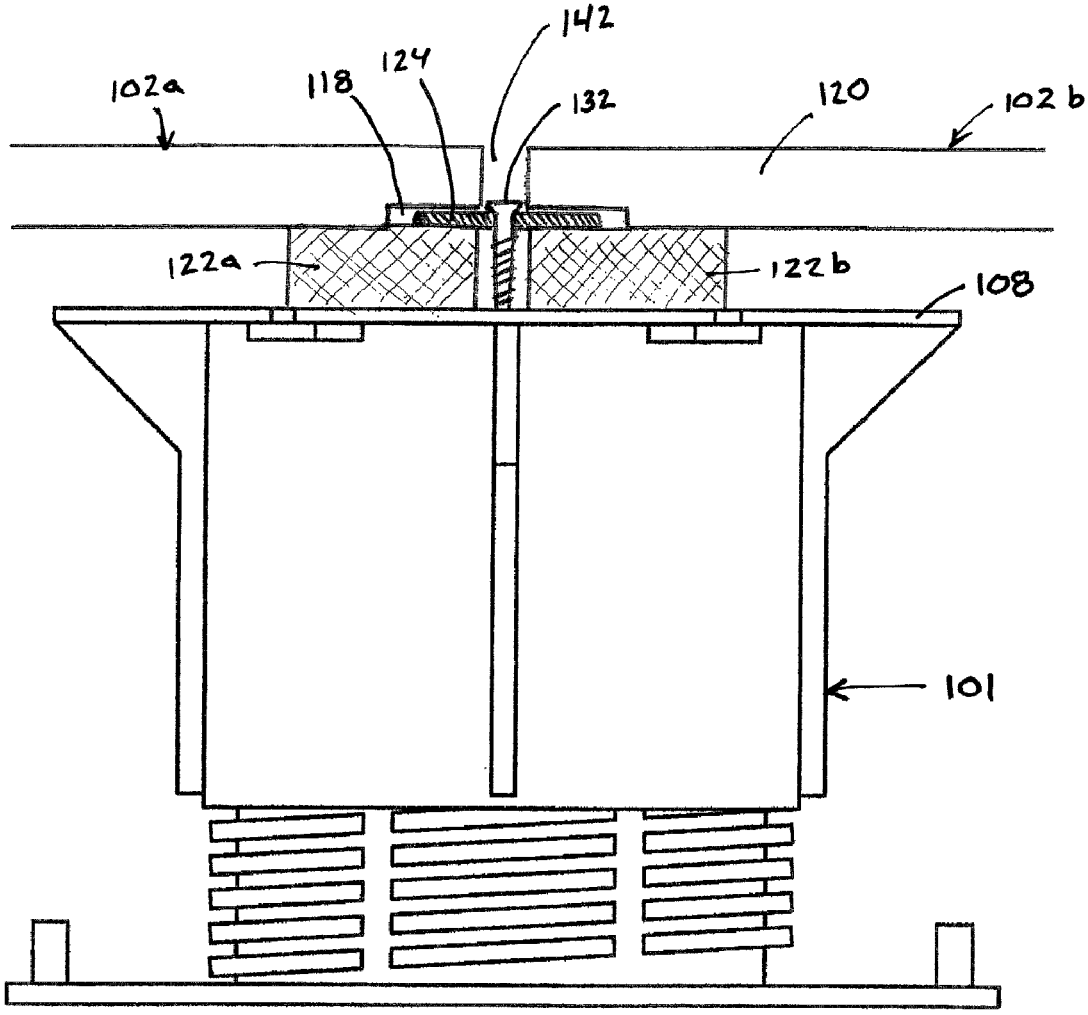
FIG. 13 illustrates a partial side view of a support pedestal supporting surface tiles in an elevated building surface assembly.

FIG. 13 illustrates a partial cross-section of surface tiles 102*a* and 102*b* anchored to a support pedestal 101. For purposes of illustration, the surface tiles 102*a* and 102*b*, the anchoring washer 124 and the fastener 132 are shown in cross-section. As is illustrated in FIG. 13, the anchoring washer 124 is disposed within the kerfs 118 of each of the surface tiles 102*a* and 102*b*. The fastener 132 is disposed through an aperture in the anchoring washer 124 and is threadably engaged with the support plate 108 of the support pedestal 101. Access to the threaded fastener 132 and the anchoring washer 124 is provided by a gap 142 that is formed between the top boards 120 of adjacent surface tiles 102.

Figure 14:
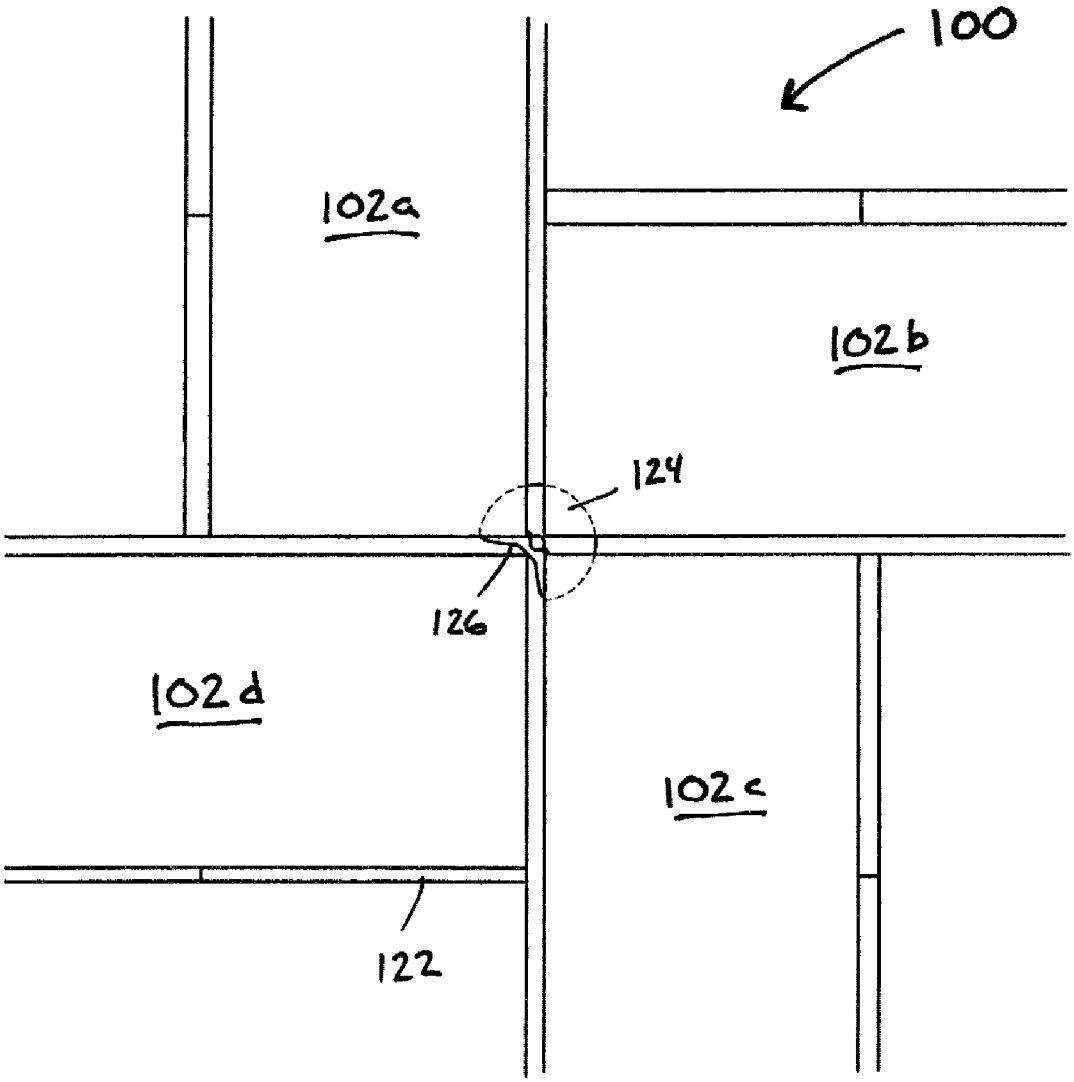
FIG. 14 illustrates a partial top view of an elevated building surface assembly where an anchoring washer is rotated to disengage a surface tile.

It is a particular advantage that the surface tiles 102 can be rapidly and conveniently removed from the elevated building surface assembly, such as to replace a defective surface tile or to access the space beneath a surface tile. FIG. 14 illustrates a top view of a portion of an elevated building surface assembly 100. As illustrated in FIG. 14, the anchoring washer 124 is rotated such that the notch 126 is in a position to disengage from the corner of the surface tile 102. That is, the anchoring washer 124 is no longer disposed within the kerf of the surface tile 102. This disengages the anchoring washer 124 from the surface tile 102*d* and can advantageously permit the surface tile 102*d* to be removed from the building surface assembly 100 without disturbing the adjacent tiles 102*a*-102*c*.

Figure 15:
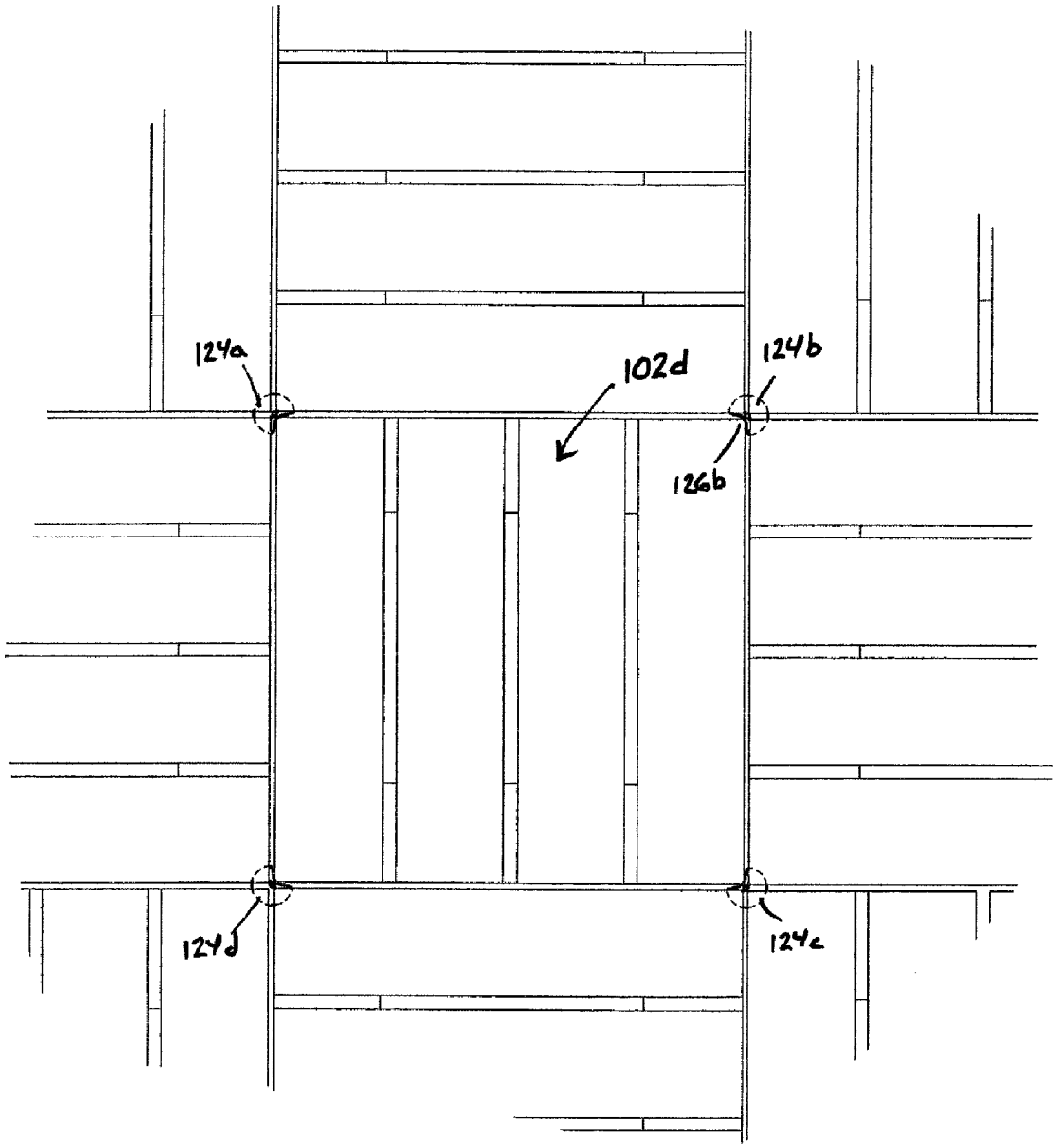
FIG. 15 illustrates a top view of an elevated building surface assembly where a plurality of anchoring washers are rotated to disengage a surface tile.
Figure 16:
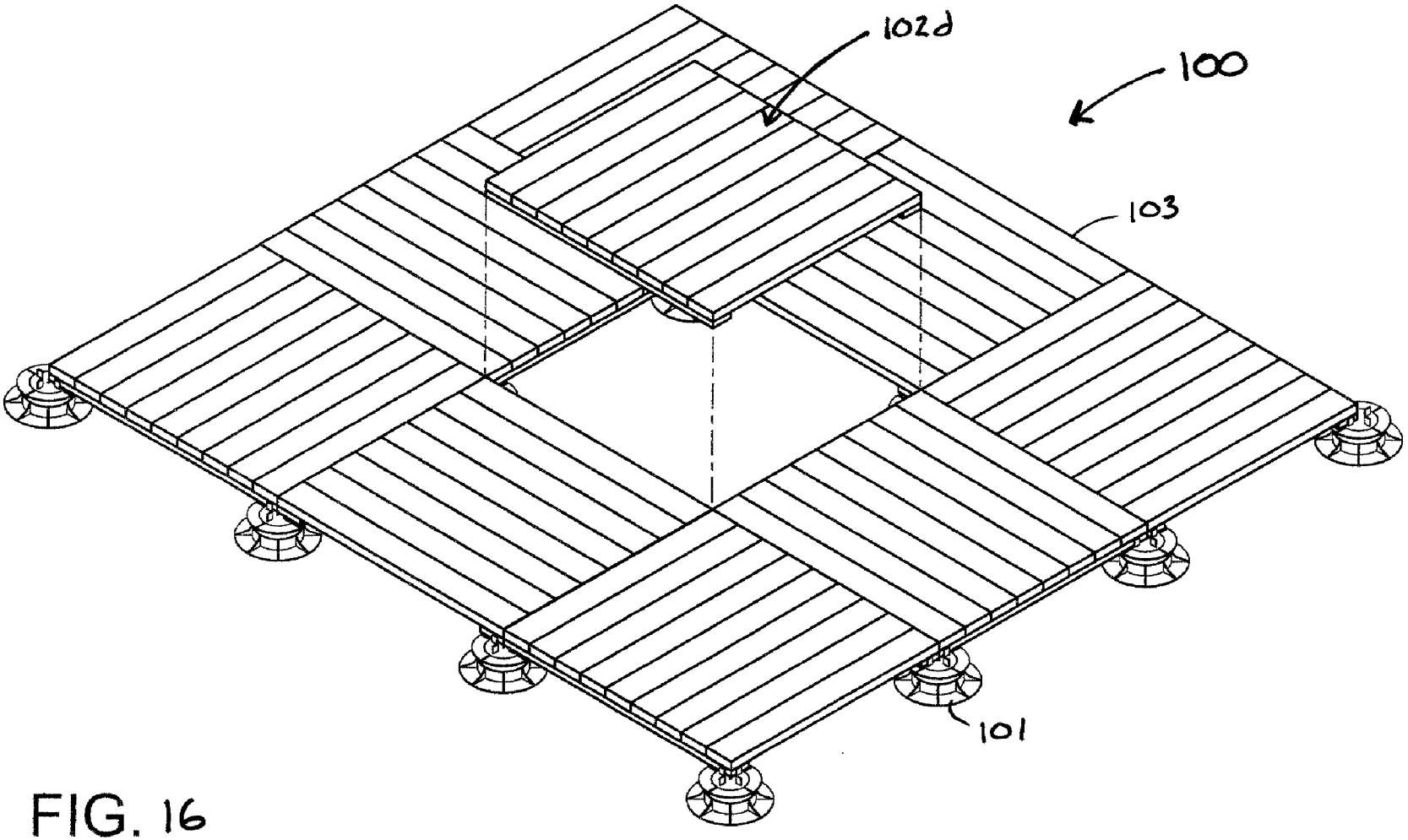
FIG. 16 illustrates a perspective view of a surface tile being removed from an elevated building surface assembly.

In this regard, FIG. 15 illustrates a top view of an elevated building surface assembly where the support washers 124*a*-124*d* in each corner of a surface tile 102*d* have been rotated to the position illustrated by FIG. 14. As can be seen from FIG. 15, the surface tile 102 is no longer anchored to a support pedestal due to the rotation of the anchoring washers 124*a*-124*d*. FIG. 16 illustrates the surface tile 102*d* being removed from the building surface 103. It is a particular advantage that a centrally disposed surface tile 102*d* can be removed from and/or inserted into the building surface 103 without requiring any adjacent surface tiles to be removed from the building surface assembly 100.

While various embodiments of the present invention have been described in detail, it is apparent that modifications and adaptations of those embodiments will occur to those skilled in the art. However, is to be expressly understood that such modifications and adaptations are within the spirit and scope of the present invention.

What is claimed is:

1. An elevated building surface assembly, comprising:

a plurality of horizontally disposed surface tiles, the surface tiles comprising at least one top board having a top surface, at least two bottom rails supporting the top board, an outer edge having a plurality of corners, and a kerf disposed in the corners where the top board meets the bottom rails below the top surface of the top board, a bottom surface of the kerf being a top surface of a bottom rail; and a plurality of support pedestals, the support pedestals being disposed beneath the corners of a plurality of adjacent surface tiles to vertically support and elevate the surface tiles above a fixed surface, the support pedestals comprising:

a base member, the base member comprising a base plate that is adapted to be placed upon a fixed surface, a cylindrical base member extension extending upwardly away from the base plate when the base member is operatively placed on a fixed surface, the base member extension comprising a base member extension cylindrical wall having base member threads disposed on a surface of the base member extension cylindrical wall;

a support member operatively attached to the base member, the support member comprising a support plate having a top surface and a cylindrical support member extension extending downwardly from the support plate, the support member extension comprising a support member extension cylindrical wall having support member threads disposed on a surface of the support member extension cylindrical wall, where the support member threads are adapted to threadably engage the base member threads to attach the support member to the base member and to adjust the height of the support pedestal when the support member is rotated relative to the base member;

an anchoring washer having a substantially circular outer perimeter and a notch intersecting the outer perimeter, the notch intersecting at least about 60 degrees and not more than about 130 degrees of the outer perimeter, wherein the anchoring washer is received within the kerfs of a plurality of the surface tiles; and a fastener adapted to fasten the anchoring washer to the support plate to anchor the plurality of surface tiles to the support plate of the support pedestal.

2. An elevated building surface assembly as recited in claim 1, wherein the fastener is a threaded fastener and wherein the anchoring washer comprises a centrally disposed aperture for receiving the threaded fastener, the aperture comprising a slot adapted to receive a tool for rotating the anchoring washer.

3. An elevated building surface assembly as recited in claim 1, further comprising a coupling member that is engaged with the base member and the support member to operatively attach the support member to the base member.

4. An elevated building surface assembly as recited in claim 1, wherein only a single notch intersects the outer perimeter of the anchoring washer.

5. An elevated building surface assembly, comprising:

a plurality of surface tiles, the surface tiles comprising:

at least one board having a top surface;

at last two bottom rails supporting the top board;

an outer edge having a plurality of corners; and a kerf disposed in the corners where the top board meets the bottom rails and below the top surface of the top board, a bottom surface of the kerf being a top surface of the bottom rail, and wherein the surface tiles are selected from wooden surface tiles, plastic surface tiles and wood-plastic composite surface tiles;

a plurality of support pedestals, the support pedestals being disposed beneath the corners of a plurality of adjacent surface tiles to vertically support and elevate the surface tiles above a fixed surface, the support pedestals comprising:

a support plate having a top surface for supporting the surface tiles, and an anchoring washer spaced apart from the top surface and being fastened to the support plate by a fastener, where the anchoring washers are disposed within the kerfs of adjacent surface tiles and below the top surface of the surface tiles to anchor the surface tiles to the support pedestals, and wherein the anchoring washers can be rotated to selectively disengage a surface tile from a support pedestal.

6. An elevated building surface assembly as recited in claim 5, wherein the anchoring washer comprises a centrally disposed aperture for receiving the fastener, the aperture comprising a slot adapted to receive a tool for rotating the anchoring washer.

7. An elevated building surface assembly as recited in claim 5, wherein the surface tiles comprise at least four corners.

8. An elevated building surface assembly as recited in claim 5, wherein the anchoring washers comprise an outer perimeter and a notch intersecting the outer perimeter of the anchoring washer.

9. An elevated building surface assembly as recited in claim 8, wherein the notch intersects at least about 60 degrees of the outer perimeter of the anchoring washer.

10. An elevated building surface assembly as recited in claim 8, wherein the notch intersects not greater than about 130 degrees of the outer perimeter of the anchoring washer.

11. An elevated building surface assembly as recited in claim 5, wherein the support pedestals have an adjustable height.

12. An elevated building surface assembly as recited in claim 11, wherein the support pedestals comprise:

a base member that is adapted to be placed upon a fixed surface, the base member comprising a base member extension that extends upwardly when the base member is operatively placed fixed surface, and a support member comprising a support member extension that is threadably attached to the base member extension.

13. An elevated building surface assembly as recited in claim 12, wherein the support pedestals further comprise a coupling member that is engaged with the base member and the support member to attach the support member to the base member.

14. An elevated building surface assembly as recited in claim 5, wherein the surface tiles are triangular.

15. An elevated building surface assembly as recited in claim 5, wherein the surface tiles are rectangular.

16. An elevated building surface assembly as recited in claim 5, wherein the fixed surface consists of a substantially horizontal fixed surface selected from the group of a rooftop, on-grade, natural ground, and a concrete slab.

17. A method for the construction of a substantially horizontal structural building surface assembly, comprising the steps of:

placing a plurality of support pedestals over a fixed surface with a predetermined spacing between the support pedestals, the fixed surface consisting of at least one selected from the group of a rooftop, on-grade, natural ground, and a concrete slab;

placing a bottom surface of a corner of each of three surface tiles upon a top surface of one of the support pedestals whereby the top surface partially vertically supports the three surface tiles in horizontally-spaced relation;

inserting an anchoring washer into adjacent kerfs that are disposed in the corners of each of the three surface tiles;

placing the bottom surface of a corner of a fourth surface tile on the top surface of the support pedestal whereby the top surface partially vertically supports the fourth surface tile;

rotating, after the inserting step, the anchoring washer to a position that is adapted to anchor the four surface tiles to the support pedestal;

inserting a fastener through the anchoring washer; and securing the fastener to the support pedestal to anchor the surface tiles to the support pedestal, wherein the surface tiles comprise at least one top board having a top surface and at least two bottom rails supporting the top board, wherein the kerfs are disposed in the corners where the top board meets the bottom rails below the top surface of the top board, a bottom surface of the kerf being a top surface of a bottom rail.

18. A method as recited in claim 17, wherein the rotating step comprises inserting a tool into a slot disposed in the anchoring washer and rotating the anchoring washer using the tool.

19. A method as recited in claim 17, wherein the anchoring washer is disposed within a kerf of the fourth surface tile after the rotating step.

* * * * *